US006083122A

United States Patent [19]

Brown

[11] Patent Number: 6,083,122

[45] Date of Patent: Jul. 4, 2000

[54] DUAL COMPOSITION GOLF TEE

[76] Inventor: Louis S. Brown, 401 Colbert Ave., Pensacola, Fla. 32507

[21] Appl. No.: 09/127,519

[22] Filed: Jul. 31, 1998

[51] Int. Cl.[7] ..... A63B 57/00

[52] U.S. Cl. ..... 473/401; 473/137

[58] Field of Search ..... 473/387–403, 473/572, 132, 135

[56] References Cited

U.S. PATENT DOCUMENTS

| | | | |
|---|---|---|---|
| 1,601,885 | 10/1926 | Samsel | 473/572 |
| 1,918,718 | 7/1933 | Samsel | 473/572 |
| 3,172,933 | 3/1965 | Flax | 264/248 |
| 3,591,896 | 7/1971 | Tartaglia | 18/19 |
| 3,633,919 | 1/1972 | Liccardello | 473/396 |
| 3,706,519 | 12/1972 | Soethje | 425/389 |
| 3,801,102 | 4/1974 | Lohr et al. | 473/572 |
| 3,858,878 | 1/1975 | Tassone | 473/398 |
| 3,961,113 | 6/1976 | Marco | 428/35 |
| 4,140,739 | 2/1979 | Cotton | 264/138 |
| 4,212,285 | 7/1980 | Cagan et al. | 473/572 |
| 4,354,495 | 10/1982 | Bodicky | 128/348 |
| 4,516,780 | 5/1985 | Tabet | 473/398 |
| 4,636,272 | 1/1987 | Riggs | 156/158 |
| 4,834,638 | 5/1989 | Miyahara et al. | 425/116 |
| 4,927,642 | 5/1990 | Kunz | 425/508 |
| 4,969,972 | 11/1990 | Kunz | 156/503 |
| 5,017,259 | 5/1991 | Kohsai | 156/294 |
| 5,085,431 | 2/1992 | McGuire | 473/398 |
| 5,160,559 | 11/1992 | Scovil et al. | 156/73.6 |
| 5,462,706 | 10/1995 | McMillan et al. | 264/138 |
| 5,549,299 | 8/1996 | Brown | 473/135 |
| 5,645,491 | 7/1997 | Brown | 473/135 |

*Primary Examiner*—Steven Wong

*Attorney, Agent, or Firm*—Dennis G. LaPointe; Mason & Associates, P.A.

[57] ABSTRACT

A dual composition polymeric device to be used as a golf tee or as a suction cup comprising a tubular-shaped polymeric stiff stem portion made from a 90–95 Shore durometer polyurethane resin elastomer bonded to a flared flexible face portion made from a 70–85 polyurethane resin elastomer wherein the device has an air passageway therein and a method of making said device.

1 Claim, 1 Drawing Sheet

DUAL COMPOSITION GOLF TEE

BACKGROUND OF THE INVENTION

1. Field of the Invention

The invention relates to a dual composition polymeric device to be used as a golf tee or as a suction cup, the device having a polymeric stiff stem portion, a polymeric flexible face portion and an internal air passage. The invention also relates to the making of said device. More particularly, the invention relates to a golf tee or a suction cup wherein the stiff stem portion is made from a 90–95 durometer polyurethane resin elastomer and is bonded to the flexible face portion which is made from a 70–85 durometer polyurethane resin elastomer.

2. Description of Related Art

Golf tees or suction cups are known in the art; however, dual composition golf tees and suction cups wherein the tee or cup is made from different durometer, a harder and a softer, polyurethane resin elastomers is novel.

Known related prior art focuses primarily on the process of bonding plastic tubing of similar materials using mandrels, molds, outer shrink tubing, expanders, among other devices, and various methods for thermally bonding the plastic parts, including injection molding processes. Such known related prior art includes U.S. Pat. No. 3,172,933 to Flax related to the manufacture of thermoplastic containers; U.S. Pat. No. 4,636,272 to Riggs related to a process of thermally bonding plastic tubes using an outer shrink tube; U.S. Pat. No. 4,354,495 to Bodicky related to a method of connecting a plastic tube within a plastic hub; U.S. Pat. No. 4,834,638 to Miyahara et al. related to an apparatus for injection molding a head end to a container; and U.S. Pat. No. 4,140,739 to Cotten related to a method for making flanged tubing. Other known related art focusing on the process of forming and bonding plastic parts include U.S. Pat. Nos. 4,927,642 and 4,969,972 to Kunz; U.S. Pat. No. 5,160,559 to Scovil et al.; U.S. Pat. No. 5,017,259 to Kohsai; U.S. Pat. No. 3,961,113 to Marco; U.S. Pat. No. 3,706,519 to Soethje; U.S. Pat. No. 5,462,706 to McMillan et al. and U.S. Pat. No. 3,591,896 to Tartaglia. The present invention may be used in golf teeing machines such as depicted in U.S. Pat. Nos. 5,645,491 and 5,549,299 to Brown.

None of the devices and processes or methods of manufacture in the above references solve the problem of providing a bonded tubular portion to a portion which has a flared face which can be used as a golf tee, or as an industrial suction cup; and wherein the portions are made of different durometer polyurethane resin elastomers in which the bonded joint can withstand high shear forces due to the impact from a golf club at impact and at the same time produce a superior vacuum seal on a dimpled golf ball surface. This combined characteristic of superior vacuum seal and shear strength allows for a smaller face diameter at the flared portion than the harder urethane tees, while providing resistance to abrasion and tearing from repeated golf club strikes. An object of the present invention would provide a device which can be used in standard hitting mats, used in conjunction with a vacuum circuitry, or used as an industrial suction cup, among numerous other possible uses where a harder durometer portion is required while, at the same time, a lower durometer portion is needed for satisfactory performance of the functional requirements.

SUMMARY OF THE INVENTION

The present invention is directed to providing a golf tee which, because of its inherent shape, can be used as an industrial suction cup, and which is made from two different durometer polyurethane resin elastomers, a harder durometer at the stem portion and a softer durometer at the flared face portion. A further object of the invention is to provide a bond at the junction of the two different durometer polyurethane resin elastomers that has superior shear strength and produces a superior vacuum seal.

A polyurethane resin golf tee requires a stiff stem. However, use of a polyurethane resin golf tee in a vacuum circuitry requires a more flexible face and an internal air passage. The harder, rigid polyurethane resin elastomer allows the golf tee to be straight while supporting the weight of the golf ball and resists permanent curling from repeated golf club strikes. The flexible polyurethane resin elastomer produces a superior vacuum seal and allows a smaller face diameter than the harder polyurethane resin elastomer while providing resistance to abrasion and tearing from repeated golf club strikes.

The preferred embodiment incorporates a higher 90–95 Shore A durometer thermoplastic polyurethane resin elastomer for the stem portion and a lower 70–85 Shore A durometer thermoplastic polyurethane resin elastomer for the face portion. For example, a stem portion made from a 95 Shore A durometer polyurethane resin elastomer combined with a flexible face portion made from an 80 Shore A durometer polyurethane resin elastomer was found to perform extremely well in a vacuum circuitry golf teeing machine. The stem portion is typically about ¼–½ inch outside diameter with an ⅛–5/16 inch inside diameter. A stem size in the ¼ inch to ⅜ inch outside diameter range with an inside diameter of about ⅛ inch to ¼ inch has been found to work well.

There are various methods of fabrication for the dual composition golf tee or suction cup. For example, the device can be made by multi-port injection molding processes, casting, compression molding, or fusion forging, among other industrial processes. The simplest preferred method if extremely large quantities are not required to be manufactured over a short period of time is the use of the fusion forging method.

In the fusion forging method, the harder tubing is cut to size and is used as a stem blank. The harder tubing is typically a thermoplastic polyurethane resin elastomer of about 90–95 Shore A durometer. The softer tubing used in the face is cut to size. This softer tubing is typically a thermoplastic polyurethane resin elastomer of about 70–85 Shore A durometer. Although it may not be required at this stage of the process, a mandrel with an outside diameter comparable to the inside diameter of the tubing, is placed inside the stem blank and the stem blank is submerged in hot, generally about 180°–200° F., water for several minutes and then quenched in cold water. This latter step of heating and quenching the stem removes the coiled memory in the tubing as some machines require a straight golf tee stem. This process of straightening the tubing can be accomplished after the tee is made, although it is preferred that it be done before.

The cut stem and face portions are placed in a drying oven at sufficient temperature, generally about 150° F., and for a sufficient time, generally about 6 hours, to remove entrapped moisture. After removing the stem and face portions from the drying oven, the stem and face portions are then placed on a mandrel so that the two portions are in contact.

The mandrel is then placed on a rotisserie for insertion in a tunnel oven in such a manner that the face portion and a small portion of the stem portion adjacent the face portion is fully enveloped in the oven. Generally, about 1–2 inches of the stem portion extends into the oven. The face portion and the enclosed stem portion are then heated at a predetermined temperature in the oven while rotating for a predetermined time, generally about 85 seconds to about 2 minutes at about 550° F.–650° F. depending on the wall thickness of the stem portion, after which the rotisserie is removed from the oven. The mandrel and the molten portions are then removed from the rotisserie and placed into a mold which closes forcing the molten portions to fuse together and forge along mold lines which forms the flared or cup part of the tee. After about 30 seconds is allowed for the cooling of the stem and face portions, the mold is opened and the formed golf tee is removed from the mold and mandrel. Any flash can then be cleaned or cut off and the golf tee is complete together with an integrated internal air passageway.

The present invention may be compounded from thermoset or thermoplastic elastomers or possibly a combination of the two. A homogeneous mixture may be adequate in some situations; however, a golf tee compounded of at least two different durometer elastomers exhibits overall superior performance and is the preferred embodiment.

The invention can be adapted for placement into a standard hitting mat as those normally encountered at most driving practice ranges. It can also be adapted for placement into an automatic golf ball teeing machine requiring vacuum circuitry wherein negative pressure holds a golf ball to the tee face and transports the ball to the strike position. The inherent design of this novel invention further allows the use of the device as an industrial suction cup.

There are numerous other shapes and uses for which the present invention motivates its use. For example, the flared portion forming the face which holds a golf ball can be shaped like a cup, a wedge shape, a flanged shaped or other shapes where the shaped portion requires a flexible portion made from a lower durometer polymeric elastomer. Further, a flexible portion can be joined to opposite ends of a stiffer durometer polymeric elastomer if the application requires it.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE INVENTION

Figure 1:
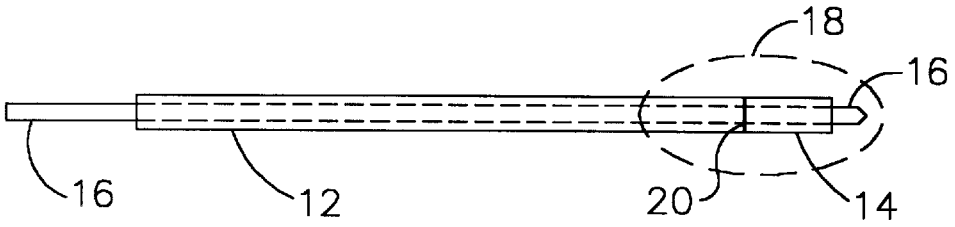
FIG. 1 is a side view of the invention in a preformed state depicting the stem portion and the face portion inserted onto a mandrel prior to forming the flared face portion and bonding the stem portion to the face portion.
Figure 2:
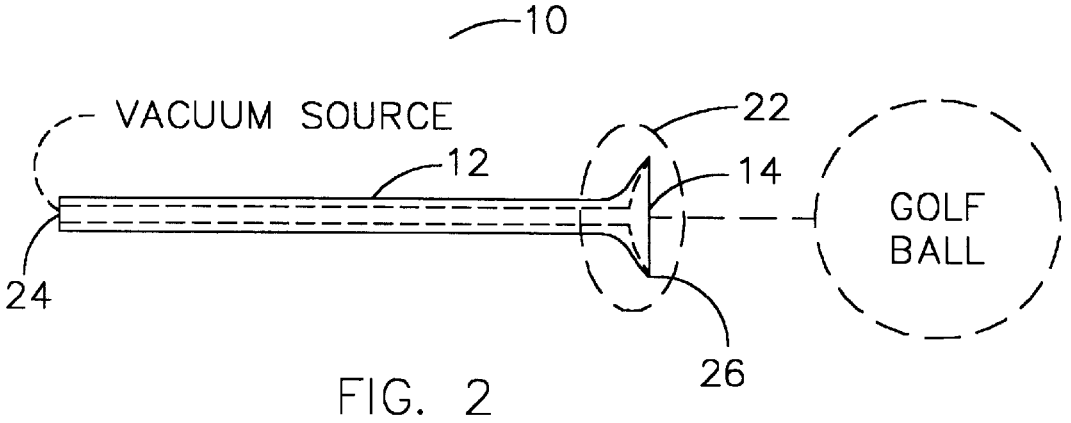
FIG. 2 is a side view of the invention formed by the bonding of the stem portion to the face portion and molding of the face portion.

Referring now to the drawings, in particular FIGS. 1 and 2, the invention which is a dual composition polymeric device to be used as a golf tee or as a suction cup and is depicted generally as 10, comprises a tubular-shaped polymeric stiff stem portion 12, said stiff stem portion 12 being hollow at 24 for the passage of air therein; and a polymeric flexible face portion 14, said flexible face portion 14 being flared at a distal end 26 and said flexible face portion 14 further being hollow at 24 for the passage of air, wherein said polymeric stiff stem portion 12 is bonded to a proximate end of said flexible face portion 14 at 20.

In the preferred embodiment, the tubular-shaped polymeric stiff stem portion 12 is made from a 90–95 Shore A durometer polyurethane resin elastomer; and the polymeric flexible face portion 14 is made from a 70–85 Shore A durometer polyurethane resin elastomer.

The present invention further includes a method of making the dual composition device, for which a schematic of the method is not shown, comprising the steps of cutting a tubular-shaped polymeric stiff stem portion, made from a 90–95 Shore A durometer polyurethane resin elastomer, a predetermined length as shown as 12 in FIG. 1; cutting a tubular-shaped polymeric flexible face portion, made from a 70–85 Shore A durometer polyurethane resin elastomer, a predetermined length as shown as 14 in FIG. 1; and providing means for heating the stiff stem portion 12, if necessary to remove the coiled memory in the tubing, in a source of hot water and heating said stiff stem portion 12 to a temperature of about 180° F.–200° F. for a predetermined time and providing means for quenching said stiff stem portion 12 and quenching said stiff stem portion 12 in a source of cold water. A mandrel 16 is inserted in the stem for heating and quenching the stiff stem portion 12.

The stiff stem portion 12 and the flexible face portion 14 are then placed in a drying oven for a predetermined time for removing entrapped moisture. The stiff stem portion 12 and the flexible face portion 14 are removed from the drying oven. The stiff stem portion 12 is then placed onto a straight mandrel 16 and the flexible face portion 14 is placed onto the same mandrel 16 so that an end of the stiff stem portion 12 is in contact with an end of the flexible face portion 14. Means for rotating the mandrel about an axis of the mandrel 16 is then provided, the means typically being a rotisserie. The flexible face portion 14 and a predetermined portion of the stiff stem portion 12 in contact with the flexible face portion on the mandrel 16 is then heated at a predetermined temperature for a predetermined time. The heated portion is depicted in FIG. 1 at 18. The mandrel 16 onto which the stiff stem portion 12 and the flexible face portion 14 have been placed is rotated during the heating process.

The mandrel 16 and molten stiff stem portion 12 and molten flexible face portion 14 are removed from the means for heating the stiff stem portion 12 and the flexible face portion 14; and the mandrel 16 and the molten stiff stem portion 12 and the molten flexible face portion 14 are removed from the means for rotating the mandrel 16 about the axis of the mandrel 16.

The mandrel 16 and the stiff stem portion 12 and flexible face portion 14 are then placed into a mold wherein the mold is closed thereby fusing together, in the zone depicted by 22 in FIG. 2, the stiff stem portion 12 and the flexible face portion 14 at junction 20 to from a uniform integrally bonded junction of the stem portion 12 and the flexible face portion 14, and forging the flexible face portion 14 and partial stiff stem portion 12 to form a flared shape at distal end 26.

The mold is then opened and the mandrel 16 is removed. Any flash from the stiff stem portion 12 and flexible face portion 14 is then cut off. The stiff stem portion 12 is bonded to the flexible face portion 14 at 20 to form a golf tee or suction cup with an air passageway 24 extending axially therein.

As seen from the foregoing description, the present invention satisfies a long felt need to provide a device wherein a harder durometer plastic tube is fused with a lower durometer plastic tube to provide a completed object which can be used in a vacuum circuit while maintaining superior shear strength and vacuum seal characteristics, and can also be made by a method which is cost effective.

The invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A dual composition device to be used as a golf tee comprising:

a tubular-shaped stiff stem portion made from a polyurethane resin elastomer material, said stiff stem portion being hollow for the passage of air therein;

a flexible face portion, said flexible face portion being flared at a distal end, being hollow for the passage of air therein, and made from a polyurethane resin elastomer material, the polyurethane resin elastomer material being 70–85 Shore A durometer;

the stiff stem portion made from a 90–95 Shore A polyurethane resin material is integrally bonded to a proximate end of said flexible face portion, the bonded stem portion and face portion being continuously hollow for the passage of air therein; and a source of vacuum for producing a vacuum through the stiff stem portion, wherein the flexible face portion produces a vacuum seal on a golf ball when a suction from the vacuum source is applied through the continuously hollow bonded stem and face portion.

* * * * *